United States Patent [19]

Gray, deceased et al.

[11] 4,275,488

[45] Jun. 30, 1981

[54] COMBINED WELL CASING SPIDER AND ELEVATOR

[76] Inventors: Charles E. Gray, deceased, late of Jena, La.; by Emma D. W. Gray, executrix, Jena, La. 71342

[21] Appl. No.: 33,081

[22] Filed: Apr. 25, 1979

Related U.S. Application Data

[63] Continuation-in-part of Ser. No. 952, Jan. 4, 1979.

[51] Int. Cl.[3] ..... E21B 19/07; A44B 21/00

[52] U.S. Cl. ..... 24/263 DC; 294/102 A

[58] Field of Search ..... 24/263 CA, 263 D, 263 DC, 24/263 DB, 263 DT, 263 SW, 263 SB, 263 DA, 249 DP; 294/102 A

[56] References Cited

U.S. PATENT DOCUMENTS

| | | | |
|---|---|---|---|
| 1,650,101 | 11/1927 | Taylor | 24/263 CA |
| 2,156,384 | 5/1939 | Fluellen | 24/263 CA |
| 2,234,489 | 3/1941 | Garrison et al. | 24/263 CA |
| 2,890,513 | 6/1959 | Lane | 24/263 CA |
| 3,675,275 | 7/1972 | Powell | 24/249 DP |
| 4,035,012 | 7/1977 | Guier | 24/249 DP |

*Primary Examiner*—Alexander Grosz

*Attorney, Agent, or Firm*—Sughrue, Rothwell, Mion, Zinn and Macpeak

[57] ABSTRACT

A combined well casing spider and elevator is formed of a main body having a downwardly tapered bowl inner wall. The main body has an open end wall having spaced apart recessed flanges on either side of the opening. A gate member is pivotally secured to one of the recess flanges and releasably secured to the other of the recessed flanges to close the open end wall when the gate is in a secured position. The gate member pivots laterally when released to permit the lateral entry of a well casing within the area defined by the bowl inner wall. A circumferential array of casing gripping slips are arranged in opposing pairs for vertical and radial mounting in surface contact with the bowl inner wall, the gripping slips forming a circular hole within the center of the array to receive a well casing. The slips are vertically moveable along the bowl inner wall to effect radial enlargement and contraction of the circular hole formed thereby by upward and downward movement respectively to release and grip the casing. A lever operates lift means within the main body including a cross bar, crank arms and lift arms to effect vertical movement of a diametrically oppose pair of casing gripping slips. The array of casing gripping slips comprise four arcuate segments, the pair of opposite slips one of which is mounted on the gate inner wall being floating segments while the other pair of slips which are connected to the lift means being driven segments. A pair of C-shaped members mounted on the tops of the floating segments interconnect with a pair of arcuate channel members mounted on the tops of the driven segments so that when the driven segments are moved vertically, the floating segments also move vertically.

13 Claims, 16 Drawing Figures

FIG. 4A
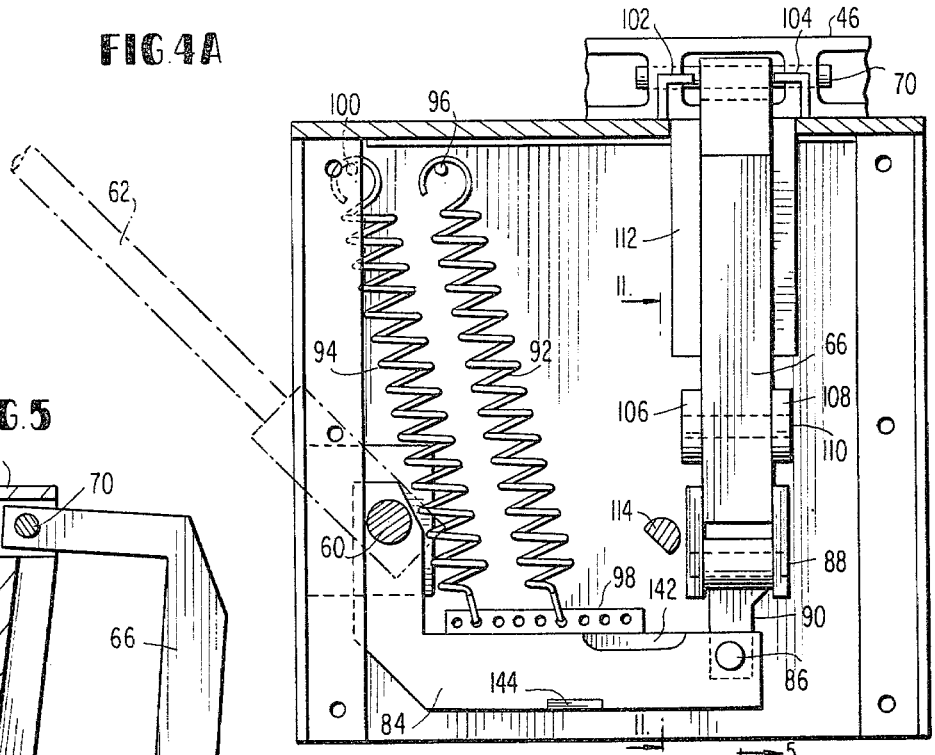
FIG. 5
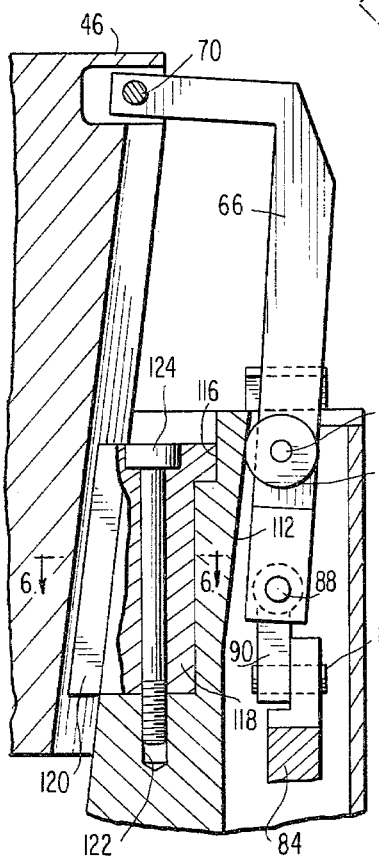
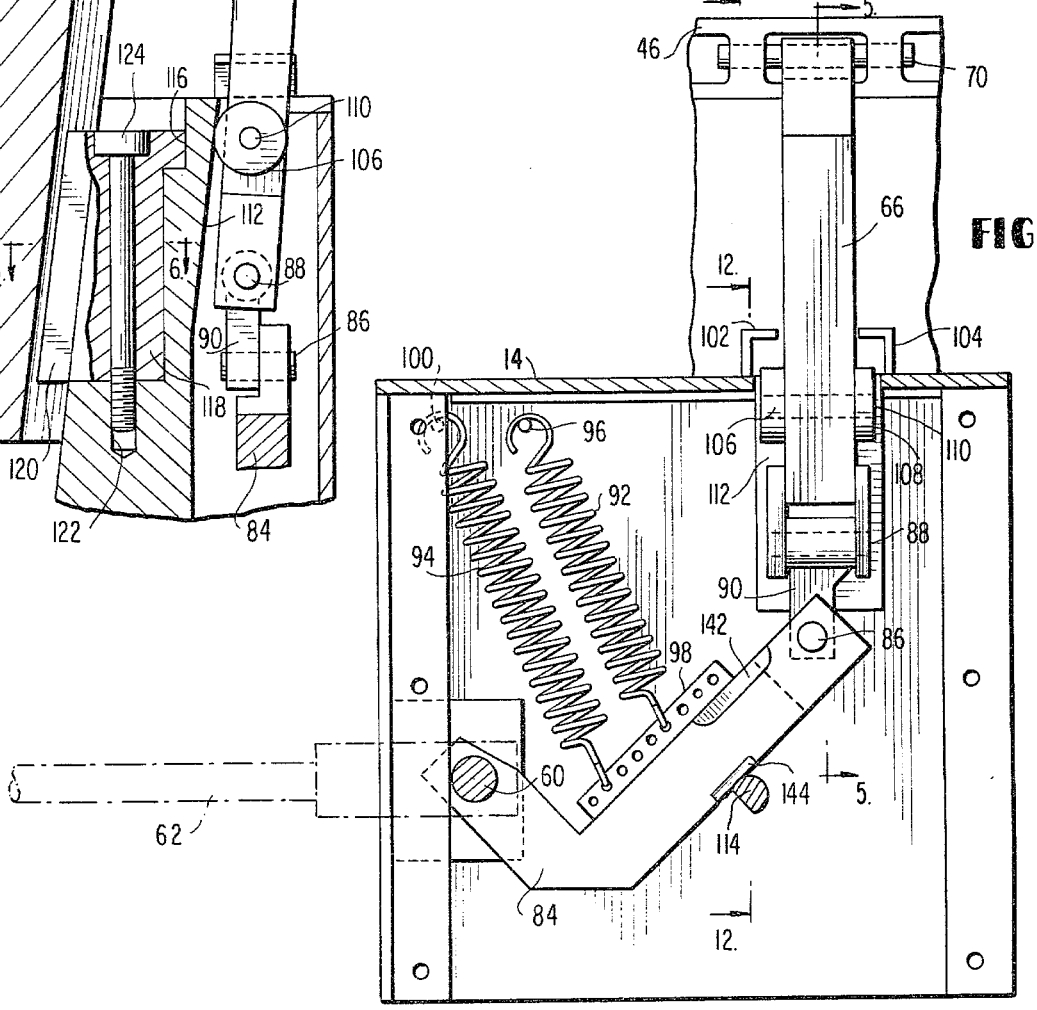
FIG. 4B

FIG. 7
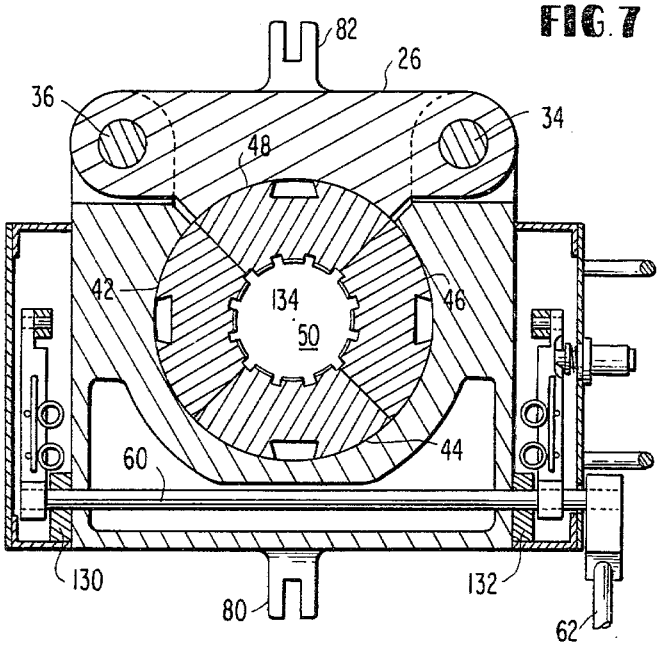
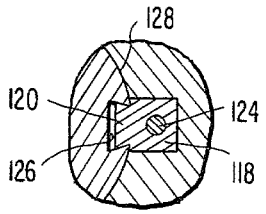
FIG. 6
FIG. 8
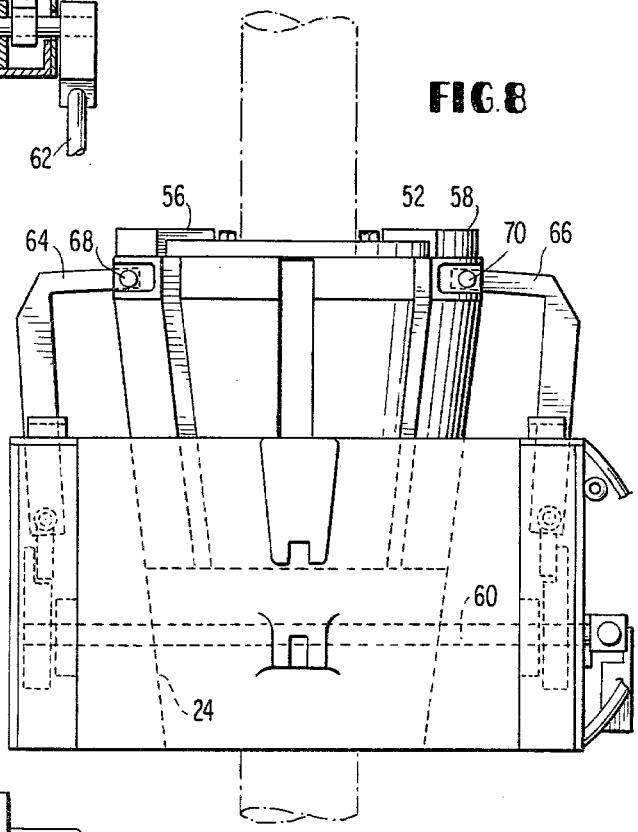
FIG. 9
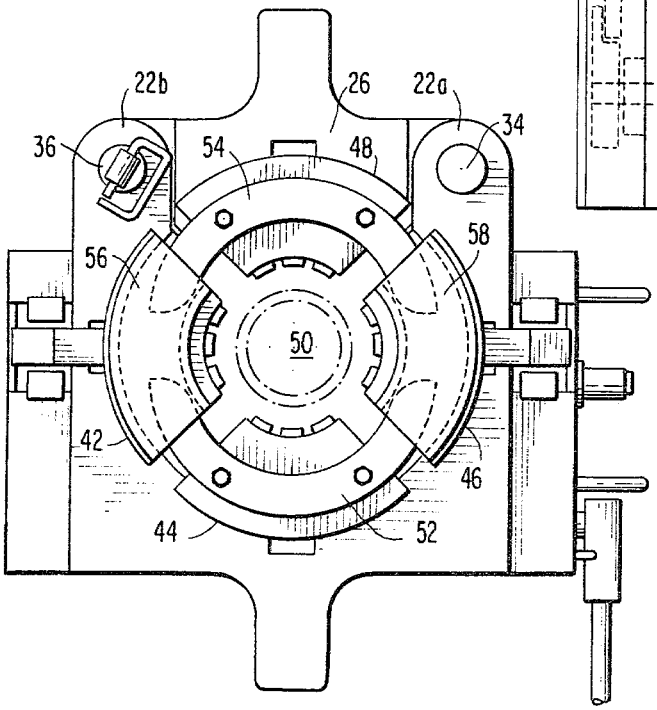

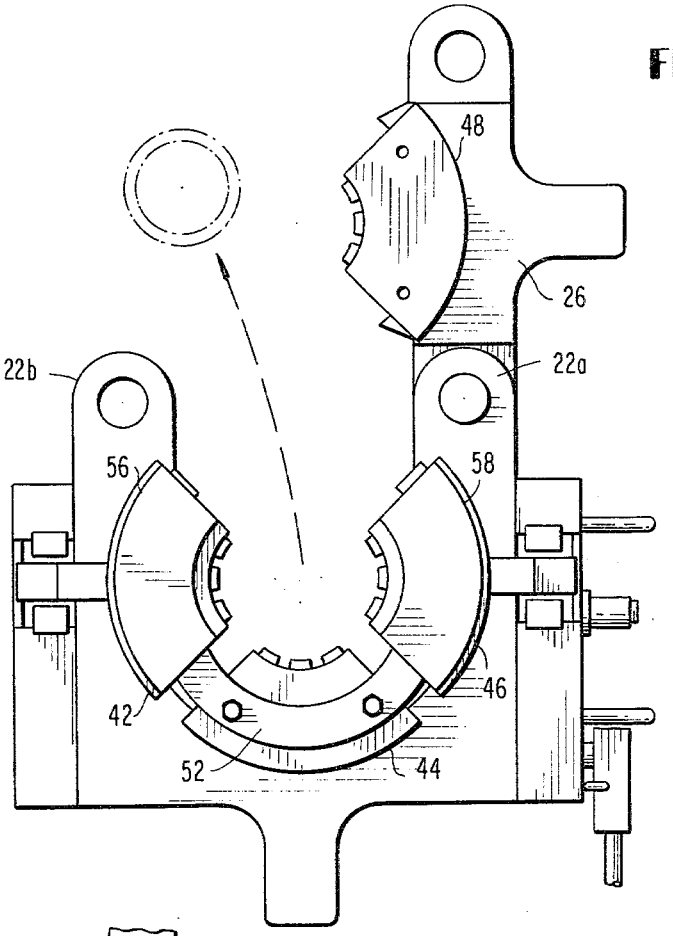
FIG. 10
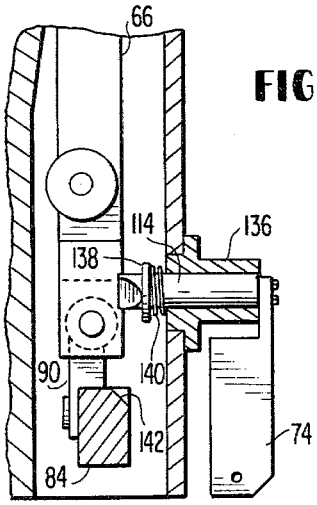
FIG. 11
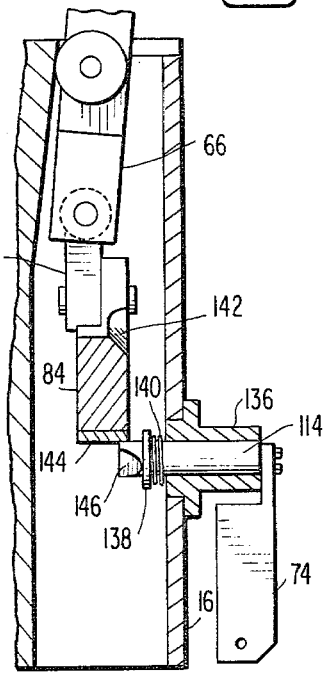
FIG. 12
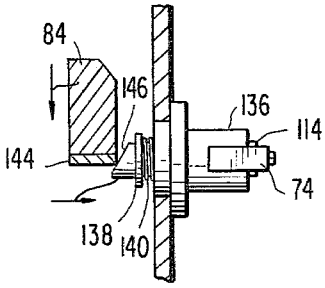
FIG. 12A
FIG. 13
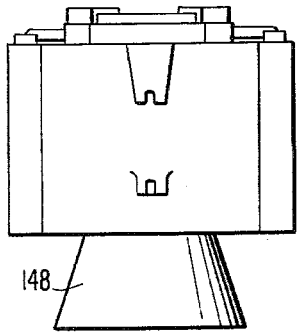
FIG. 14
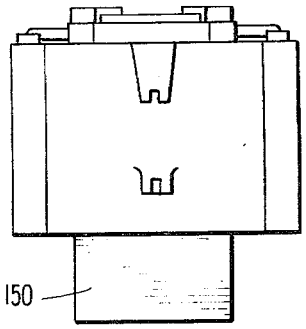

COMBINED WELL CASING SPIDER AND ELEVATOR

CROSS REFERENCE TO RELATED APPLICATION

This application is a continuation-in-part application of my co-pending application Ser. No. 952 filed Jan. 4, 1979, and entitled "Well Casing Spider".

BACKGROUND OF THE INVENTION

The present invention generally relates to oil well casing spiders and elevators used in the oil fields to effect the insertion and removal of drill stem and well casing segments, and more particularly to a combined well casing spider and elevator which may be used interchangeably as the spider or the elevator and includes a laterally pivotable gate member which permits ease in the entry and removal of a drill stem and/or well casing segment. In the specification and the appended claims, reference will only be made to the gripping, release, insertion and removal of a well casing, but it is to be expressly understood that the combined well casing spider and elevator according to the invention is not limited in its use to well casings alone and can be used with well casings, drill stems and other pipe or rod-like members.

To effect the lowering and raising of long strings of oil well casings, a spider is conventionally mounted over the rotary on the platform of the oil well drilling derrick. The spider is operable to grip or release a segment of the well casing. An elevator attached to a hoist co-operates with the spider in the lowering and raising of well casing and is also operable to grip or release the well casing. Well casing is removed, for example, by lowering of the elevator so that it can grip the end of the well casing extending above the spider. The spider then releases the well casing and the elevator is hoisted until the end of the next segment of well casing extends above the spider. The spider agains grips the well casing, and the segment removed by the elevator is disconnected by rotating it. This segment can then be off loaded allowing the elevator to be again lowered to grip the end of the well casing projecting above the spider to repeat the process.

Conventionally, a plurality of arcuate wedge-shaped scepter-like elements or slips formed of cast metal such as steel are borne by a spider bowl which is hollow and whose interior surface tapers upwardly and outwardly. These slips ride on the tapered surface of the spider bowl, being normally keyed thereto, and means are provided for simultaneously raising and lowering of the slips in contact with the tapered surface of the hollow spider bowl such that, when the slips are raised, they move radially away from each other to increase the size of the opening defined by the slips through which passes the well casing. One such type of well spider is shown in U.S. Pat. No. 2,274,273, issued Feb. 24, 1942, to Earl J. Miller.

While the well spider of that construction functions adequately to perform its given task, it is necessary to physically shift the spider between extreme vertical heights with respect to the well casing, normally requiring the unit to be raised above the upper end of the well casing or well casing sections to be gripped prior to lowering the spider into position. Moreover, while the elevator performs a similar, co-operating gripping function, the construction of the elevator is quite different from that of the spider, the two not being interchangeable, requiring on-site spares for each. Further, the mechanical actuating and slip interior section mechanism is generally out of direct access making it both difficult and dangerous to repair or adjust the mechanism or replace a damaged slip.

SUMMARY OF THE INVENTION

It is, therefore, an object of the present invention to provide a combined well casing spider and elevator which can be used intechangeably thereby requiring only one on-site spare.

It is another object of the invention to provide a combined well casing spider and elevator which, when used as a spider, can be quickly positioned with respect to the well casing without the necessity of vertically raising the spider above the casing and which can be moved into casing encompassed position at any desired vertical level with respect to the casing.

It is a further object of the invention to provide a combined well casing spider and elevator which may be moved laterally relative to the well casing to effect the surrounding of the well casing by the slips which grip the casing.

These and other objects of the invention are attained by providing a main body including a base wall, a top wall, a pair of lateral walls, a first end wall and a second end wall, the second end wall having two sections spaced from one another. The main body further includes a bowel inner wall tapered to reduce diameter from the top wall to the bottom wall. A gate member is pivotably secured to one of the sections of the second end wall and releasably secured to the other of the sections to connect the sections when in a secured position. The gate member pivots laterally when released to permit the lateral entry of a well casing within the area defined by the bowl inner wall. The gate member has a gate inner wall which co-operates with the bowl inner wall to comprise a bowl section. A circumferential array of casing gripping slips are arranged in opposing pairs for vertical and radial mounting in surface contact with the bowl inner wall. As the gripping slips from a circular hole within the center thereof to receive a well casing and are vertically movable along the bowl inner wall to effect radial enlargement and contraction of the circular hole formed thereby by upward and downward movement respectively to release and grip the casings. A cross rod spans the main body and extends into bearing journals attached to each of the lateral walls of the main body. A lever is fixedly attached to the cross rod and is vertically movable to rotate the cross rod in the bearing journals. First and second crank arms are fixedly attached to the cross rod adjacent either lateral wall and movable with the cross rod to rotate in respective vertical planes. First and second lift arms pivotably connected at one end to the first and second crank arms and pivotably connected at the other end to the upper end of a pair of diametrically opposed gripping slips. In the preferred embodiment, the array of casing gripping slips comprises four arcuate segments, the pair of slips one of which is mounted on the gate inner wall being floating segments with the other pair which are connected to the lift arms being driven segments. A pair of C-shaped members are mounted to the top of the floating segments and circumferentially project beyond the edges thereof towards the tops of the driven segments. A pair of arcuate channel members are mounted on the top of the driven segments and slideably receive the ends of the C-shaped members so that when the driven segments are moved vertically, the floating segments move with the driven segments. The C-shaped member mounted on the top of the segment which is mounted to the gate inner wall is removable to facilitate the lateral pivoting of the gate. There is further provided a latch for releasably engaging one of the crank arms when it is rotated to its upwardmost position. The latch may be conveniently released by pulling on a lanyard, for example.

The construction of the invention allows for a degree of safety and ease of use not heretofore available. The mechanical actuating and slip mechanism is directly accessible so that it is not necessary for a worker to reach within the bowl interior to repair or adjust the mechanism or replace a slip. The laterally pivoting gate member provides both ease of use permitting the rapid engagement and disengagement of the mechanism with a well casing and safety to the worker since it is no longer necessary to physically shift the mechanism between extreme vertical heights with respect to the well casing.

BRIEF DESCRIPTION OF THE DRAWINGS

The foregoing and other objects, advantages and aspects of the invention will be better appreciated from the following detailed descriptions of a preferred embodiment with reference to the accompanying drawings, in which:

FIGS. 4A and 4B are cross sectional views taken along the section lines in FIG. 2 showing the lift mechanisms in the lowered and raised positions respectively;

FIG. 5 is a cr6ss sectional view taken along the section lines in FIG. 4B showing details of the key way construction and a portion of the lift mechanism;

FIG. 6 is a fragmentary cross sectional view taken along the section lines in FIG. 5 showing another view of the key way construction;

FIG. 7 is a cross sectional view taken along the section lines in FIG. 2 showing the interior construction of the combined well casing spider and elevator according to the preferred embodiment;

FIG. 8 is a front elevation view showing the gripping slips and of their raised position;

FIG. 9 is a top plan of view also showing the gripping slips in their raised position;

FIG. 10 is a top plan view similar to FIG. 9 but showing the gate member laterally pivoted outwardly to facilitate the insertion or removal of a well casing;

FIG. 11 is a fragmentary cross sectional view taken along the section lines shown in FIG. 4A showing the latching mechanism when the lift mechanism is in its lowermost position;

FIG. 12 is a fragmentary cross sectional view taken along the section lines in FIG. 4B showing the latching mechanism when the lift mechanism is in its upwardmost position;

FIG. 12A is a detailed view taken from FIG. 12 showing the manner in which the latching mechanism is released;

FIG. 13 is a simplified front elevational view of the combined well casing spider and elevator fitted with a bell housing for use as an elevator; and, FIG. 14 is a simplified elevational view showing the combined well casing spider and elevator fitted with a base member for use as a spider.

DESCRIPTION OF THE PREFERRED EMBODIMENT

Figure 1:
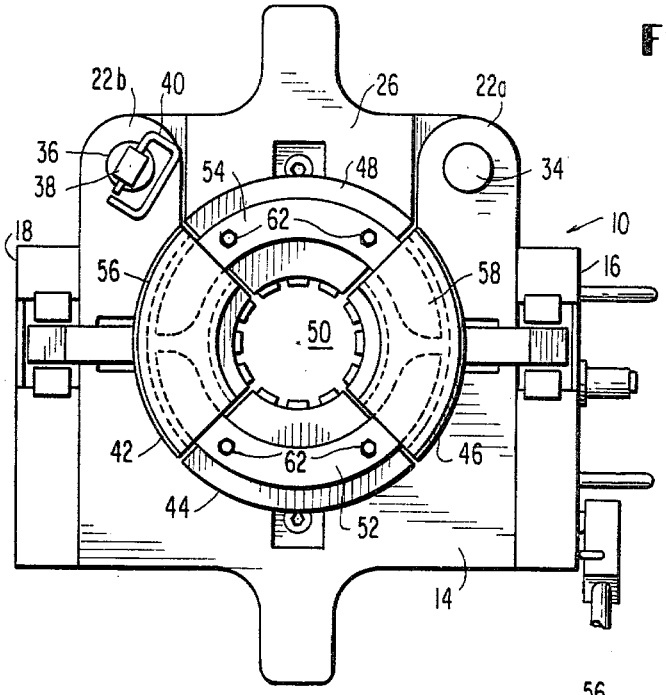
FIG. 1 is a top plan view of the combined well casing spider and elevator according to the preferred embodiment of the invention.
Figure 2:
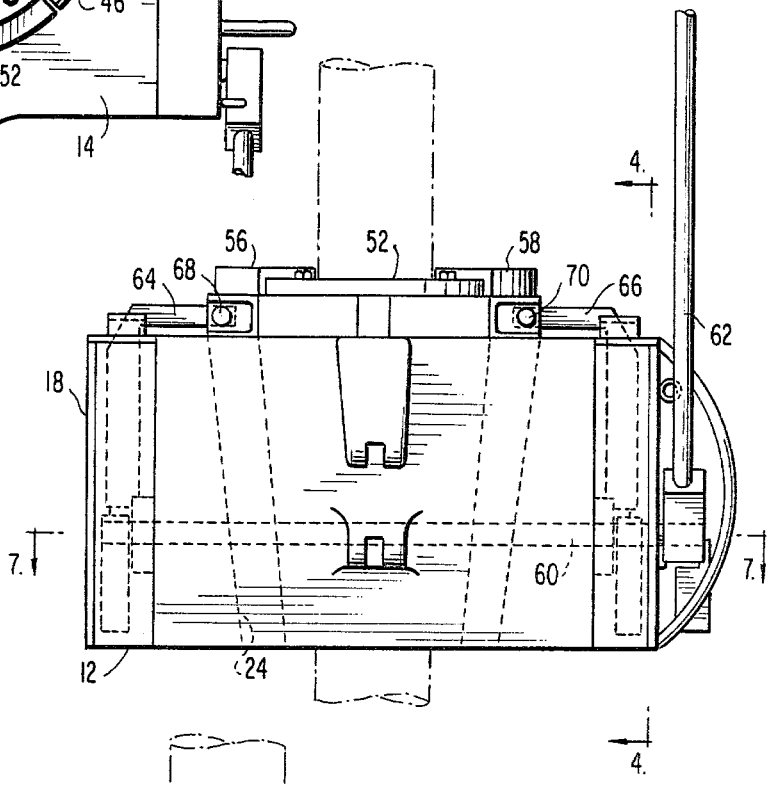
FIG. 2 is a front elevational view of the combined well casing spider and elevator.
Figure 3:
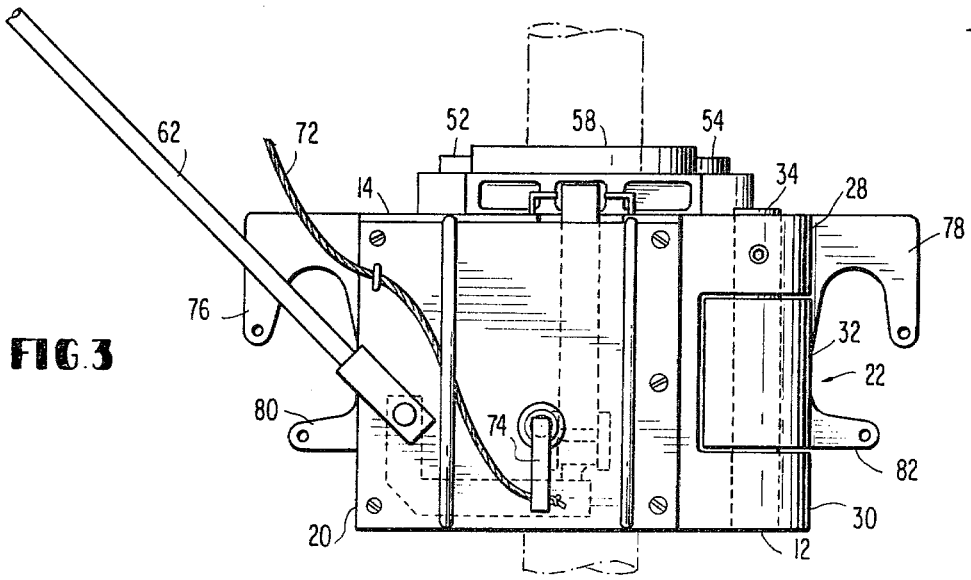
FIG. 3 is a side elevational view of the combined well casing spider and elevator.

Referring first to FIGS. 1, 2 and 3 of the drawings, the combined well casing spider and elevator comprises a main body 10 having a generally square configuration and including a base wall 12, a top wall 14, a pair of lateral walls 16 and 18, a first end wall 20 and a second end wall 22. The second end wall 22 as best seen in FIG. 1 has two sections **22*a* and 22*b* spaced from one another. The main body may be fabricated of steel structure or steel casting and further includes a bowl inner wall 24 tapered to reduced diameter from the top wall 14 to the bottom wall 12. A gate member 26 to be described in more detail hereinafter, is pivotably secured to section 22*a* and releasably to section 22*b* as can best be seen in FIG. 1. The gate member 26 has an inner wall co-operating with the bowl inner wall 24 to comprise a bowl section. As best seen in FIG. 3, the two sections of the end wall 22 comprise spaced flanges 28 and 30, and the gate member 26 has opposed lugs 32 projecting outwardly on opposite ends thereof. The flanges and the lugs carry bores of similar size. A pivot pin 34 projects through the bores of the flanges of section 22*a* and the aligned bore of the co-operating lug on the gate member 26 to define a pivot axis for the gate member. As shown in FIG. 1 a removable locking pin 36 is carried within the aligned bores of the flanges of section 22*b* and the co-operating lug of the gate member 26. The pin 36 has a central projection 38 at its upper end which hingedly carries a D-ring 40, permitting by grasping of the D-ring 40, the lifting of the locking pin 36 so as to release the gate member and permit it to laterally pivot outwardly to an open position as shown in FIG. 10**.

Still with reference to FIGS. 1, 2 and 3, a circumferential array of casing gripping slips 42, 44, 46 and 48 are arranged in opposing pairs for vertical and radial mounting in surface contact with the bowl inner wall 24. The gripping slips form a circular hole 50 within the center thereof to receive a well casing and are vertically movable along the bowl wall 24 to effect radial enlargement and contraction of the circular holes formed thereby by upward and downward movement respectively to release and grip the casing. The casing gripping slips 42, 44, 46 and 48 comprise four arcuate segments, of which segment 48 is mounted on the gate inner wall. The gripping slips 42 and 46 which are diametrically opposed to one another are connected to a lifting mechanism and are, therefore, driven segments, while the gripping slips 44 and 48 are also diametrically opposed to one another, are floating segments. The floating segmemnts are, however, connected to the driven segments by circumferentially slidable couplings at their tops so that as the driven segments are moved vertically, the floating segments move with the driven segments. In my co-pending application, Ser. No. 952 filed Jan. 4, 1979, these slidable couplings took the form of a set of sleeves attached to the upper surfaces of the segments at the circumferential edges thereof, each set of sleeves being opposed to one another and in axial alignment with sleeves of adjacent segments. One of the sleeves of each pair had fixedly mounted therein one end of a dowel whose opposite end was slidably received in the other of the sleeves of the pair carried by adjacent segments. This arrangement allows the gripping slips 42, 44, 46 and 48 to separate circumferentially as they move radially outward with respect to the axis of the assembly and center of hole 40 formed by these members.

While the foregoing arrangement of sleeves and dowel is quite satisfactory for providing slidable couplings at the tops of the grippings slips 42, 44, 46 and 48, as shown in FIG. 1, the slidable couplings in the preferred embodiment disclosed herein are replaced by a pair of C-shaped members 52 and 54 and a pair of arcuate channels 56 and 58. More particularly, the C-shaped members have generally the same radius of curvature of the arcuate segments or gripping slips and are mounted to the tops of the floating segments and circumferentially project beyond the edges thereof towards the tops of the driven segments. C-shaped member 52 is mounted to the top of gripping slip 44 by means of, for example, bolts 60, while C-shaped member 54 is mounted to the top of gripping slip 48 by means of bolts 62. As will become apparent by the description which follows, the bolt 62 must be removed and the C-shaped member 54 dismounted from the top of gripping slip 48 to allow the gate 26 to pivot laterally. The arcuate channel members 56 and 58 also generally have the same radius of curvature as of the arcuate segments or gripping slips. The channel members 56 and 58 are mounted on the top of gripping slips 42 and 46, respectively and each slidably receives the adjacent end of the C-shaped members 52 and 56. The channel members 56 and 58 can, if desired, be permanently attached to the tops of their respective gripping slips 42 and 46 as by welding. However, to facilitate the ready interchangability of the gripping slips, it is preferred to attach the channel member with bolts (not shown).

As shown in FIG. 2 the lifting mechanism which will be described in more detail with reference to other figures of the drawing, comprises a cross rod 60 standing as the main body and extending into bearing journals attached to each of the lateral walls of the main body. The cross rod 60 extends through the bearing journal and the lateral wall on the right side of the main body. A lever 62 is fixedly attached to the cross rod 60 and vertically movable to rotate the cross rod in its bearing journals. L-shaped lift arms 64 and 66 are pivotably attached at 68 and 70, respectively, to the gripping slips 42 and 46. As will become clear from the following description, pulling of the lever 62 downwardly causes a rotation of the cross rod 60 which results in the upward movement of lift arms 64 and 66. This upward movement of the lift arms 64 and 66 effects an upward movement of the entire array of casing grippings slips relative to the bowl inner wall 24. When the lift arms 64 and 66 are moved to their upwardmost position, the lift mechanism is releasably latched in this position. The latch can be released by pulling on the lanyard 72 which is attached at one end to the pivot arm 74 of the latch mechanism as shown in FIG. 3.

With continued reference to FIG. 3, the first end wall 20 and the second end wall 22 are each provided with outwardly projected lugs 76 and 78, respectively which have a generally hook configuration. These lugs are provided for facilitating the lifting of the mechanism by means of chains, cables or the like. Below the hook shaped lugs 76 and 78 are outwardly projecting co-operating lugs 80 and 82, respectively. Holes are drilled in the ends of each of the lugs 76, 78, 80 and 82. These holes are designed to receive a safety link (not shown) which is attached after the lugs 76 and 78 have been engaged with a lifting chain or cable. More specifically, a safety link is releasably attached between the ends of lugs 76 and 80, and another safety link is releasably attached between the ends of lugs 78 and 82.

The lifting mechanism is shown in more detail in the cross sectional views of FIGS. 4A, 4B and 5, to which reference is now made. As previously described the lever 62 is fixedly attached to the cross rod 60 so that as lever 62 in FIG. 4A is pulled downwardly in FIG. 4B, the cross rod 60 rotates in a counter-clockwise direction. A crank arm 84 is also fixedly attached to the cross rod 60 near the lateral side 16 of the main body. Another crank arm (not shown) is also fixedly attached to the cross rod 60 but adjacent to the lateral wall 18. These crank arms are movable with the cross rod 60 to rotate in respective vertical planes as the lever 62 is moved vertically. The cross rod 60 is positioned adjacent the front wall of the main body, and the crank arms extend toward the central axis of the main body between the first and second end walls 20 and 22. The crank arm 84 is pivotally connected to the end of the long arm of the L-shaped lift arm 66. This is a double pivot connection having perpendicular pivot axes 86 and 88 at either end of a pivot length 90. This connection allows the lift arm 66 to not only move upwardly but also outwardly as the crank arm 84 rotates in a counter-clockwise direction about the axis of the cross rod 60. A similar connection between the crank arm adjacent the lateral wall 18 and the lift arm 64. To aid in the manual lifting operation, lift springs 92 and 94 are provided. Spring 92 is connected at one end to a pin 96 mounted on the lateral wall 16 and at the other end to a hole in a plate 98 welded to the top of the crank arm 84. The spring 94 is connected at one end to a pin 100 mounted to the lateral wall 16 and at the other end to a hole in the plate 98. The plate 98 is provided with a plurality of holes allowing the springs 92 and 94 to be attached at different positions so that the desired spring tension can be attained. The spring bias of the springs 92 and 94 as to help lift the crank arm 84 as the lever 62 is moved vertically downward. Thus, as shown in FIG. 4A, the springs 92 and 94 are extended while in 4B the springs are contracted.

As the crank arm 84 rotates in a counter-clockwise direction above to the axis of the cross rod 60, the lift arm 66 moves upwardly and outwardly. This movement is guided in part by L-shaped brackets 102 and 104 welded to the top wall 12 on either side of an opening through which the lift arm 66 projects. Further, the lift arm 66 is provided with a pair of rollers 106 and 108 mounted on either side thereof to rotate about a pivot 110 having an axis offset toward the inner face of the lift arm 66. These rollers 106 and 108 contact an inclined surface 112 formed on an interior surface of the main body. Thus, as the lift arms 66 moves upwardly, the rollers 106 and 108 contacting the inclined surface 112 cause the lift arm 66 to also move outwardly. While not shown, it will be understood that a similar construction exists for the lift mechanism connecting it to the lift arm 64 adjacent the lateral wall 18. As the crank arm 84 rotates in a counter-clockwise direction, it passes a spring loaded indent pin 114 which engages the bottom edge of the crank arm 84 to latch the lift mechanism in its uppermost position. This latch mechanism is described in more detail with reference to FIGS. 11 and 12 hereinafter.

Referring now to FIGS. 5 and 6, the upper end of the tapered surface of the bowl inner wall 24 is provided with recesses 116 at circumferentially spaced locations to receive rectangular blocks 118 which include a tee 120 projecting outwardly from a surface portion or side wall which is parallel and constitutes an extension of the tapered surface of the bowl inner wall 24. A vertical bore 122 is tapped and threaded to receive a bolt 124 which rigidly mounts block 118 within the recess 116. The keys 120 fit within keyways 126 of like dovetail horizontal cross-section provided within confronting radially outer surfaces 128 of individual gripping slips 42, 44, 46 and 48.

FIG. 7 shows the combined well casing spider and elevator according to the preferred embodiment of the invention in cross section taken through the section lines 7—7 shown in FIG. 2. This view shows in more detail the cross rod 60 extending through bearing journals 130 and 132 attached to the lateral walls of the main body. It will also be observed in this view that a crank arm similar to crank arm 84 is attached to the opposite end of cross rod 60. The gripping slips 42, 44, 46 and 48 are identical segments and readily interchangeable. The radially inner surface 134 of each of the gripping slips bears parallel, narrow, radially outward projecting ribs which are serrated to grip the well casing.

FIGS. 8 and 9 are front elevation and top plan views respectively showing the combined well casing spider and elevator with the lift mechanism in its uppermost position as shown in more detail in FIG. 4B. The corresponding views with the lift mechanism in its lowermost position corresponding to the detailed view shown in FIG. 4A are FIGS. 2 and 1, respectively. The lift mechanism may be in either the upper or lower positions when the gate member 26 is laterally pivoted outwardly to permit the lateral entry of a well casing within the area defined by the bowl inner wall 24. FIG. 10 shows the gate member pivoted outwardly when the lift mechanism is in its uppermost position so that the gripping slips are circumferentially separated from one another. In order to release the gate member 26 it is first necessary to remove bolts 62 and dismount the C-shaped member 54 from the top of the gripping slip 48. Then, the D-ring 40 attached to the top of locking pin 36 is grasped and pulled to remove the locking pin thereby allowing the gate member 26 to be laterally pivoted outwardly as shown in FIG. 10. This in turn allows the lateral insertion or removal of a well casing thereby avoiding the necessity of shifting the mechanism vertically as was necessary in the prior art.

With particular reference now to FIGS. 11, 12 and 12A, the latching mechanism comprises a pin 114 mounted within a housing 136 attached to the lateral wall 16. The pin projects through the lateral wall 16 and slightly beyond the crank arm 84. A washer 138 is fixed to the pin 114 by welding or the like and acts as a stop for spring 140, the other stop for the spring being the wall 16. The crank arm 84 is provided with a camming surface 142 which engages the end of the pin 114 causing it to rotate and to be retracted as the crank arm 84 moves vertically upward from the position shown in FIG. 11 to that shown in FIG. 12. Once the crank arm 84 passes the pin 114, the spring 140 urges the pin to return to its original orientation to engage the bottom edge of the crank arm 84 to prevent its movement downwardly. Where the crank arm 84 engages the indent pin 114, the crank arm is provided with a hardened steel plate 144. The end of pin 114 also has a camming surface 146, but this camming surface is normally directed away from the crank arm 84 when the crank arm 84 is in its upwardmost position. The indent pin 114, however, is rotatable by means of the latch release arm 74 which is attached to the end of the pin 114 which projects out of the housing 136. When the arm 74 is pulled by lanyard 72, the indent pin 114 rotates against the spring bias so as to present its camming surface 146 to the bottom edge of the crank arm 84 as shown in FIG. 12A. In this position, the downward force of the crank arm due to the weight it supports causes the indent pin 114 to be retracted against the bias of spring 140 so that the crank arm can move vertically downward.

As may be appreciated, the unusually compact design of the mechanism allows it to be used as either a well casing spider or elevator. When used as an elevator, it is merely necessary to attach a bell housing 148 to the bottom wall of the main body as shown in FIG. 13. The bell housing 148 serves as a guide to properly direct a well casing into the circular hole defined by the gripping slips. On the other hand, when used as a spider, a base member 150 is attached to the base wall as shown in FIG. 14, this base member co-operating with the rotary in the platform of the well drilling derrick.

While the invention has been particularly shown and described with reference to a preferred embodiment thereof, it will be understood by those skilled in the art that various changes in form and details may be made therein without departing from the spirit and scope of the invention.

What is claimed:

1. A combined well casing spider and elevator comprising:

a main body including a base wall, a top wall, a pair of lateral walls, a first end wall, and a second end wall, the second end wall having two sections comprising recessed flanges spaced from one another, said main body further including a bowl inner wall tapered to reduced diameter from the top wall to the bottom wall;

a gate member pivotally secured to one of the sections of the second end wall and releasably secured to the other of said sections to connect said sections when in a secured position, and pivoting laterally when released to permit the lateral entry of a well casing within the area defined by said bowl inner wall, the gate member having a gate inner wall co-operating with the bowl inner wall to comprise a bowl section, said gate inner wall carrying a vertically movable and removable slip member;

a circumferential array of casing gripping slips arranged in opposing pairs for vertical and radial mounting in surface contact with said bowl inner wall, said gripping slips forming a circular hole within the center thereof to receive a well casing and vertically movable along the bowl inner wall to effect radial enlargement and contraction of the circular hole formed thereby by upward and downward movement respectively to release and grip the casing; and means connected to at least one pair of said casing gripping slips for effecting vertical movement of the entire array of casing gripping slips relative to said bowl inner wall, said means carried by a rotatable cross rod each end of which extends into bearing journals attached to the insides of each of said lateral walls.

2. The combined well casing spider and elevator as recited in claim 1, wherein each of the two sections of said second end wall comprises spaced flanges, said gate member having opposed lugs projecting outwardly on opposite ends, and wherein said flanges and lugs carry bores of similar size, further comprising a pivot pin projecting through the bores of the flanges of one of said two sections and the aligned bore of one of said lugs to define a pivot axis for said gate member, and a removable locking pin carried within the aligned bores of the flanges of the other of said two sections and the other of said lugs.

3. The combined well casing spider and elevator as recited in claim 1, wherein said array of casing gripping slips comprise four arcuate segments arranged in pairs, one slip of one pair mounted on said gate inner wall and the other of said pair diametrically opposite thereto, said pair comprising floating segments, and the other pair of slips being connected to said means for effecting vertical movement and being driven segments.

4. The combined well casing spider and elevator as recited in claim 3, wherein said means for effecting vertical movement includes a plurality of circumferentially slidable couplings of equal dimension at the tops of said four arcuate segments, exteriorly thereof, thus providing an interconnection between adjacent segments so that said floating segments move vertically with the movement of said driven segments, one of said circumferentially slidable couplings removable to permit said gate to pivot laterally open upon removal of said locking pin.

5. The combined well casing spider and elevator as recited in claim 4 wherein said circumferentially slidable couplings comprise:

a pair of C-shaped members of equal dimension having generally the same radius of curvature of said arcuate segments, said C-shaped members being mounted on the tops of said floating segments, externally accessable thereof, and circumferentially projecting beyond the edges thereof toward the tops of said driven segments, at least one of the C-shaped members mounted on the top of the segment mounted on the gate inner wall being removable to facilitate the lateral pivoting of said gate; and a pair of arcuate channel members having generally the same radius of curvature of said arcuate segments, said channel members being mounted on the tops of said driven segments, exteriorly accessable thereof for receiving the ends of said C-shaped members.

6. The combined well casing spider and elevator as recited in claim 1, wherein said means for effecting vertical movement comprises:

bearing journals attached to each of the lateral walls of said main body;

a cross rod spanning the main body and extending into said bearing journals;

a lever fixedly attached to said cross rod and vertically movable to rotate said cross rod in said bearing journals;

first and second crank arms fixedly attached to said cross rod adjacent either lateral wall and movable with said cross rod to rotate in respective vertical planes, said first and second crank arms extending toward the central axis of the main body between said first and second end walls; and first and second lift arms pivotally connected at one end to said first and second crank arms, respectively, and movable vertically with the rotation of said crank arms, said first and second lift arms being respectively connected at their other ends to said at least one pair of gripping slips.

7. The combined well casing spider and elevator as recited in claim 6, whereon said first and second lift arms are L-shaped having a short arm and a long arm with the short arm being pivotally attached to the upper end of the corresponding gripping slip, the long arm being attached to the corresponding crank arm by a double pivot having perpendicular pivot axes, said main body further including first and second vertically outwardly inclined surfaces adjacent the long arms of said first and second lift arms, respectively, further comprising first and second roller means respectively attached to the long arms of said first and second lift arms and contacting said first and second inclined surfaces.

8. The combined well casing spider and elevator as recited in claim 7, further comprising latch means for releasably engaging at least one of said first and second crank arms when the crank arms are rotated to move said lift arms to their upwardmost position.

9. The combined well casing spider and elevator as recited in claim 8, wherein said latch means comprises a spring loaded indent pin mounted on one of said lateral walls, said at least one of said crank arms having a camming surface which engages the end of said indent pin causing it to be retracted against the spring bias as the crank arm rotates vertically upward, the indent pin then engaging the crank arm to prevent its rotation vertically downward, the end of said indent pin having a further camming surface normally directed away from the crank arm when in its upwardmost position, said indent pin being rotable to present said further camming surface for engagement with the crank arm to allow the downward force of the crank arm to cause the indent pin to be retracted against the spring bias so that the crank arm can rotate vertically downward.

10. The combined well casing spider and elevator as recited in claim 6, further comprising lift springs attached at one end to said main body and at the other end to said crank arms, said lift springs providing a bias tending to aid the upward movement of said lift arms.

11. The combined well casing spider and elevator as recited in claim 6, wherein said array of casing gripping slips comprise four arcuate segments, one pair of diametrically opposed slips including the one mounted on said gate inner wall comprising floating segments, and the other pair of slips being connected to said means for effecting vertical movement and being driven segments, said means for effecting of vertical movement including circumferentially slidable couplings at the tops of said four arcuate segments providing an interconnection between adjacent segments so that said floating segments move vertically with the movement of said driven segments.

12. The combined well casing spider and elevator as recited in claims 7 or 11, wherein said circumferentially slidable couplings comprise:

a pair of C-shaped members of equal dimension having generally the same radius of curvature of said arcuate segments, said C-shaped members being mounted on the tops of said floating segments and circumferentially projecting beyond the edges thereof toward the top of said driven segments, at least the C-shaped member mounted on the top of the segment mounted on the gate inner wall being removable to facilitate the lateral pivoting of said gate; and a pair of arcuate channel members having generally the same radius of curvature of said arcuate segments, said channel members being mounted on the tops of said driven segments and receiving the ends of said C-shaped members.

13. A combined well casing spider and elevator comprising:

a main body including a base wall, a top wall, a pair of lateral walls, a first end wall, and a second end wall having an opening therein, the second end wall further having recessed flanges spaced from one another and positioned on either side of said opening;

said main body containing a major portion of a segmented bowl member tapered to reduce the diameter thereof from the top wall to the bottom wall;

a gate member including a minor portion of said segmented bowl member pivotally secured to one of said recessed flanges and releasably attached to the other of said recessed flanges, said gate member including said minor portion of said segmented bowl member when in secured position forms a complete bowl structure for supporting casing gripping elements;

a circumferential array of casing gripping slips arranged in opposing pairs for vertical and radial movement within said bowl form a circular hole within the center of said array;

said circumferential array comprising four slip elements two of which opposite each other within said major portion being driven elements and the other two one of which is movably and removably attached to said gate member comprise floating elements;

said driven and floating elements interconnected externally thereof by C-shaped connector elements of equal dimension, one of said C-shaped connector elements removably attached to said gate member, said C-shaped elements cooperating with a pair of channel members mounted to the tops of said driven elements, exteriorly thereof, to effect locking of said circumferential array together and to prevent said gate member from opening;

means connected to at least one of said pairs of gripping slips for effecting vertical movement of the entire array of said gripping slips relative to said bowl member, said means carried by a rotatable cross bar which extends into bearing journals attached to the insides of said lateral walls.

* * * * *